United States Patent [19]

Walter

[11] Patent Number: 4,819,745

[45] Date of Patent: Apr. 11, 1989

[54] FLOW PULSING APPARATUS FOR USE IN DRILL STRING

[75] Inventor: Bruno H. Walter, Edmonton, Canada

[73] Assignee: Intech Oil Tools Ltd, Edmonton, Canada

[21] Appl. No.: 8,963

[22] Filed: Jan. 30, 1987

Related U.S. Application Data

[63] Continuation-in-part of Ser. No. 626,121, Jun. 29, 1984, abandoned.

[30] Foreign Application Priority Data

Jul. 8, 1983 [CA] Canada ..... 432054

[51] Int. Cl.[4] ..... E21B 4/02

[52] U.S. Cl. ..... 175/107; 175/232; 175/317

[58] Field of Search ..... 175/38, 105, 107, 243, 175/296, 297, 232, 234, ; 367/84, 85; 125/317

[56] References Cited

U.S. PATENT DOCUMENTS 701,391 6/1902 Pruszkowski .
2,287,157 6/1942 Wolff .
2,743,083 4/1956 Zublin .
2,780,438 2/1957 Bielstein .
2,942,851 6/1960 Beck ..... 175/296 X
3,096,833 7/1963 Bodine .
3,105,560 10/1963 Zublin .
3,415,330 12/1968 Bouyoucos .
3,416,613 12/1968 Henderson .
3,441,094 4/1969 Galle et al. .
3,568,783 3/1971 Chenoweth .
3,768,576 10/1973 Martini .
3,807,512 4/1974 Pogonowski et al. .
4,434,863 3/1984 Garrett .

*Primary Examiner*—Jerome W. Massie
*Assistant Examiner*—David J. Bagnell
*Attorney, Agent, or Firm*—Robert M. Phipps

[57] ABSTRACT

A simple and economical device is placed in a drill string to provide a pulsating flow of the pressurized drilling fluid to the jets of the drill bit to enhance chip removal and provide a vibrating action in the drill bit itself thereby to provide a more efficient and effective drilling operation.

31 Claims, 7 Drawing Sheets

FLOW PULSING APPARATUS FOR USE IN DRILL STRINGCROSS-REFERENCE TO RELATED APPLICATION

This is a conti9nuation-in-part of my co-pending U.S. application Ser. No. 626,121 filed June 29, 1984 now abandoned.

BACKGROUND OF THE INVENTION

In the drilling of deep wells such as oil and gas wells, it is common practise to drill utilizing the rotary drilling method. A suitably constructed derrick suspends the block and hook arrangement, together with a swivel, drill pipe, drill collars, other suitable drilling tools, for example reamers, shock tools, etc. with a drill bit being located at the extreme bottom end of this assembly which is commonly called the drill string.

The drill string is rotated from the surface by the kelly which is rotated by a rotary table. During the course of the drilling operation, drilling fluid, often called drilling mud, is pumped downwardly through the hollow drill string. This drilling mud is pumped by relatively large capacity mud pumps. At the drill bit this mud cleans the rolling cones of the drill bit, removes or clears away the rock chips from the cutting surface and lifts and carries such rock chips upwardly along the well bore to the surface.

In more recent years, around 1948, the openings in the drill bit allowing escape of drilling mud were equipped with jets to provide a high velocity fluid flow near the bit. The result of this was that the penetration rate or effectiveness of the drilling increased dramatically. As a result of this almost all drill bits presently used are equipped with jets thereby to take advantage of this increased efficiency. It is worthwhile to note that between 45–65% of all hydraulic power output from the mud pump is being used to accelerate the drilling fluid or mud in the drill bit jet with this high velocity flow energy ultimately being partially converted to pressure energy with the chips being lifted upwardly from the bottom of the hole and carried to the surface as previously described.

As is well known in the art, a rock bit drills by forming successive small craters in the rock face as it is contacted by the individual bit teeth. Once the bit tooth has formed a crater, the next problem is the removal of the chips from the crater. As is well known in the art, depending upon the type of formation being drilled, and the shape of the crater thus produced, certain crater types require, much more assistance from the drilling fluid to effect proper chip removal than do other types of craters. For a further discussion this see "Full Scale Laboratory Drilling Tests" by Terra-Tek Inc., performed under contract Ey-76c-024098 for the U.S. Department of Energy.

The effect of drill bit weight on penetration rate is also well known. If adequate cleaning of the rock chips from the rock face is effected, doubling of the bit weight will double the penetration rate, i.e. the penetration rate will be directly proportional to the bit weight. However, if inadequate cleaning takes place, further increases in bit weight will not cause corresponding increases in drilling rate owing to the fact that formation chips which are not cleared away are being reground thus wasting energy. If this situation occurs, one solution is to increase the pressure of the drilling fluid thereby hopefully to clear away the formation chips in which event a further increase in bit weight will cause a corresponding increase in drilling rate. Again, at this increased drilling rate, a situation can again be reached wherein inadequate cleaning is taking place at the rock face and further increases in bit weight will not significantly affect the drilling rate and, again, the only solution here is to again increase the drilling fluid pumping pressure thereby hopefully to properly clear the formation chips from the rock face to avoid regrinding of same. Those skilled in the art will appreciate that bit weight and drilling fluid pressure must be increased in conjunction with one another. An increase in drilling fluid pressure will not, in itself, usually effect any change in drilling rate in harder formations; fluid pressure and drill bit weight must be varied in conjunction with one another to achieve the most efficient result. For a further discussion of the effect of rotary drilling hydraulics on penetration rate, reference may be had to standard texts on the subject.

It should also be noted that in softer formations, the bit weight that can be used effectively is limited by the amount of fluid cleaning available below the bit. In very soft formations the hydraulic action of the drilling fluid may do a significant amount of the removal work.

In an effort to increase the drilling rate, the prior art has provided vibrating devices known as mud hammers which cause a striker hammer to repeatedly apply sharp blows to an anvil, which sharp blows are transmitted through the drill bit to the teeth of the rolling cones. This has been found to increase the drilling rate significantly; the disadvantage however is that the bit life is significantly reduced. In a deep well, it is well known that it takes a considerable length of time to remove and replace a worn out bit and hence in using this type of conventional mud hammer equipment the increased drilling rate made possible is offset to a significant degree by the reduction in bit life.

One proposal for cyclically interrupting flow through a drill stem is disclosed in U.S. Pat. No. 2,780,438 issued Feb. 5, 1957. This patent proposes the use of a rotary value member actuated by a spiral rotary value actuator. Axially disposed co-operating passages are provided in the valve structure and thrust bearings take up axially oriented loads on the rotary valve member. Disadvantages of this proposal include the fact that the axially oriented passages are prone to blockage by debris. The high shock forces on the rotary valve member would tend to rapidly destroy the thrust bearings supporting the rotary valve. The overall arrangement would be very inefficient in providing fluctuating forces on the drill bit. The free telescoping movement of the housing above the rotary valve would destroy most of the desired water hammer effect and would appear to eliminate most of the pressure drop below the bit considering that the apparatus is acting in a closed system.

Another prior art flow pulsing arrangement is shown in the Zublin U.S. Pat. No. 2,743,083 issued Apr. 24, 1956. This patent shows several embodiments of an invention. In all of these embodiments, however, the arrangement is such that pressure pulses above the rotor and consequent pressure drops below the rotor act on almost the whole projected area of the rotor. High axial forces on the rotor bearings result thus materially shortening the bearing life. Furthermore, the valving arrangements provided are prone to jamming due to debris in the drifting fluid and if sufficient clearance is provided to alleviate jamming problems the structural configuration of the valve makes it difficult to achieve a meaningful level of pressure build-up.

OBJECTS AND SUMMARY OF INVENTION

It is a general object of the present invention to provide improved means for increasing drill bit penetration rate such as by providing improved chip removal from a bore hole. It is a further object of the invention to provide a relatively simple and economical structure capable of providing a pulsating flow of the pressurized drilling fluid to the jets of the drill bit and which equipment is also capable of providing a vibrating action in the drill bit itself. A specific object is to provide improved flow pulsing which is constructed so as to alleviate binding or jamming by virtue of grit and other debris in the drill fluid and which provides a longer operational life between maintenance periods.

In one form of the invention, the flow pulsing apparatus includes an external housing adapted to be connected in a tubular drill string above a drill bit and to be supplied, in use, with pressurized drilling fluid via the drill string. Suitable means are provided within such housing for cyclically restricting the flow of drilling fluid through the housing from the inlet to the outlet end of same thereby to create a fluctuating or pulsating pressure in the drilling fluid. In use, this pulsating flow of pressurized fluid is made available to the jets of the drill bit. The cyclical flow restrictions, by virtue of the acceleration and deceleration of the column of drilling fluid within the drill string, serve to apply pulsating mechanical forces to the drill bit. The above-noted flow pulsing means includes a rotor having blades which is adapted to rotate in response to the flow of drilling fluid through the housing. A rotary valve means forms part of the rotor and alternately restricts and opens fluid flow passages thereby to create the cyclical pressure fluctuations.

The flow passages preferably comprise generally radially arranged port means in a valve section of the housing with the rotary valve means being arranged to rotate in co-operating relationship to said port means to alternatively open and close the radial port means during rotation.

One important feature of the invention is that the rotor including its associated valve means is essentially hydraulically balanced. During operation, as the flow is varied or pulsed, fluid momentum forces create substantial pressure changes. The structural configuration of the flow pulsing means is such that the pressure changes act on virtually the entire effective area of the rotor assembly in all directions whereby these forces are taken up internally by the rotor and its valve means and not transmitted, to any appreciable degree, to the rotor support bearings. The apparatus is also resistant to plugging resulting from debris in the drilling fluid.

Another important feature of a modified form of the invention is the provision of a relatively loose bearing system for supporting the rotor such that it is free to vibrate relative to the housing during use. The rotor is deliberately unbalanced dynamically (although hydraulically balanced) to enhance the vibrating effect. The support bearings are made of a hard material to resist wear but no seals are used to inhibit flow of drilling fluid into or out of the bearing area. The vibrating action of the rotor provides a self-cleaning action which clears grit out of the bearings while at the same time large particles which might interfere with the interacting valve surfaces and jam the rotor tend to be cleared away. As a result the clearances between these valve surfaces can be made smaller than would otherwise be permitted thus enabling the water hammer effect to be enhanced. At the same time the prior art problems associated with conventional sealed bearings including seal failure in the extremely hostile environment provided by the drilling fluid and lubricant contamination leading to premature bearing failure are eliminated.

In a one form of the invention the above-described apparatus can be attached to a form of shock tool which responds to the pulsating fluid pressure by expanding and contracting so that, in effect, it functions similar to a mud hammer. However, since the force is applied hydraulically with no extremely sharp pressure peaks, the bit life is not adversely affected to any significant degree.

The pulsating action enables one to take advantage of the inertia effects of the long column of drilling fluid standing in the drill string and hence the peak pressure made available to the drill bit jets can be made much greater than that available utilizing conventional techniques. At the same time it should be realized that this substantially increased bit jet pressure does not require the use of additional high volume, high pressure pumping equipment thus keeping both equipment and operating costs at reasonable levels.

Another aspect of the invention concerns the provision of improved screening means for removing heavy grit from the flow of drilling fluid before it enters the flow pulsing means. This screening means is also designed to provide improved (longer) service life between maintenance periods.

Preferred embodiments of the invention will be described hereafter. It will be seen that this novel apparatus permits a substantial number of variables to be altered at will. For example, both the frequency and amplitude of the fluid pressure pulses can be preselected in accordance with requirements. In the case where the equipment is combined with a form of shock tool, the amplitude of the mechanical force can be suitably regulated by varying either the pressure or the areas of the shock tool which are exposed to the fluctuating hydraulic pressures.

Further objects of the invention, and further aspects of the invention and the advantages associated with same will be apparent to those skilled in the art from the following description of preferred embodiments of the invention when read in conjunction with the accompanying drawings.

BRIEF DESCRIPTION OF THE VIEWS OF DRAWINGS

Figure 12A:
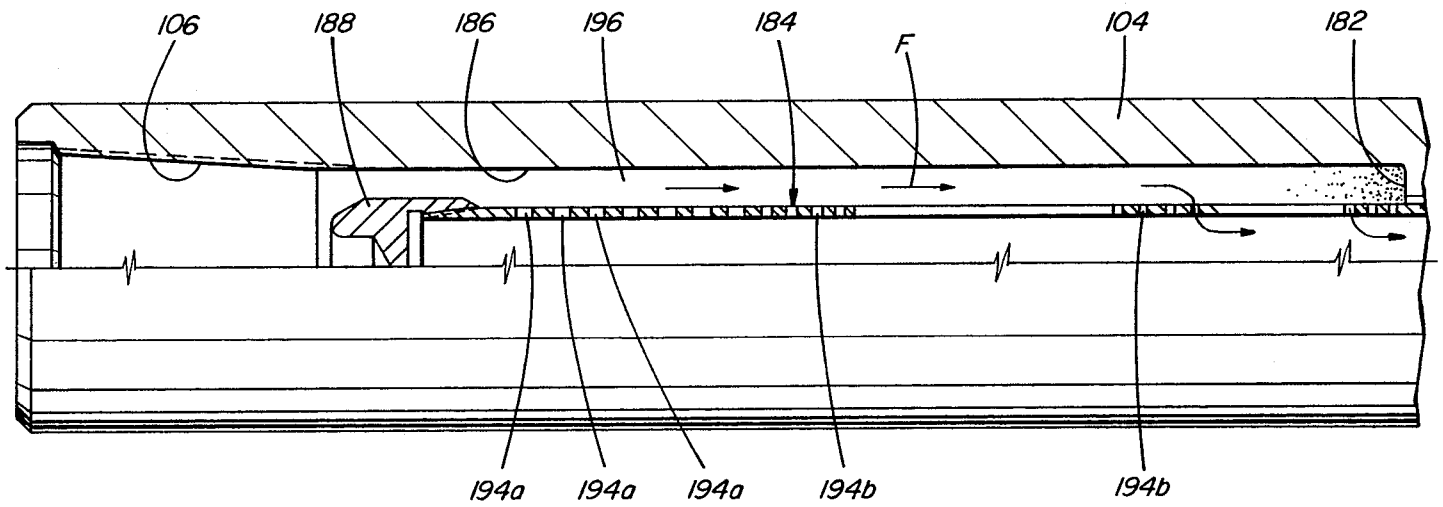
Figure 12B:
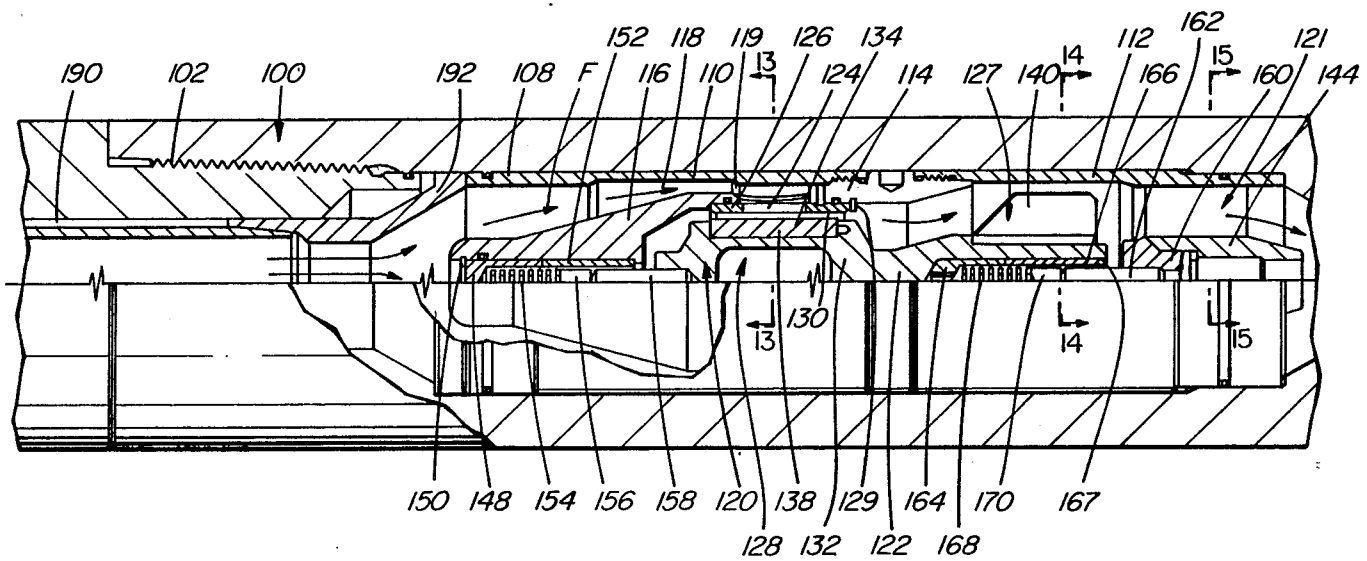
Figure 12C:
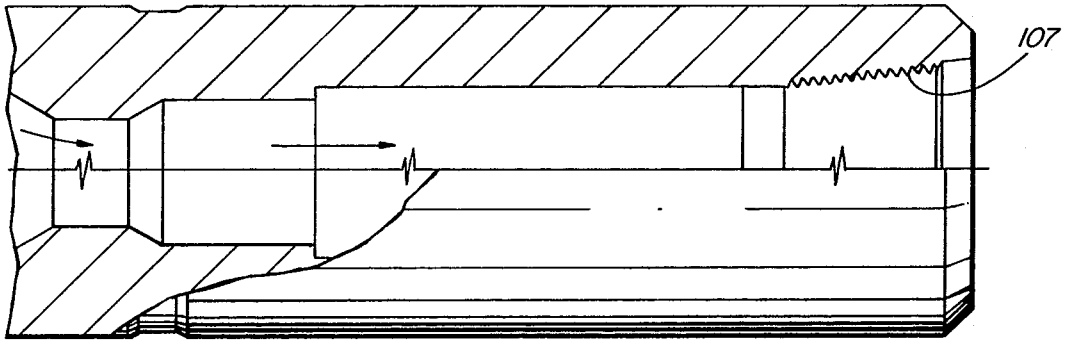
Figure 13:
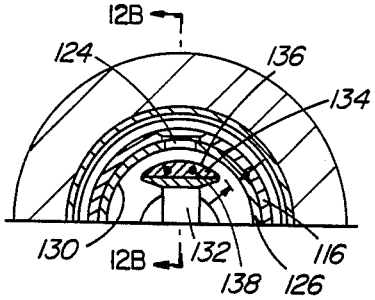
Figure 14:
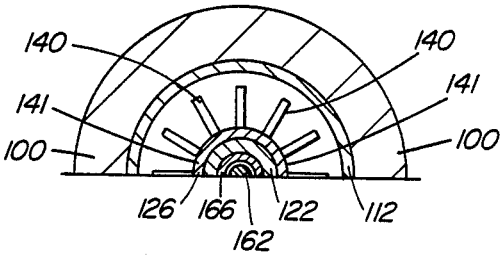
Figure 15:
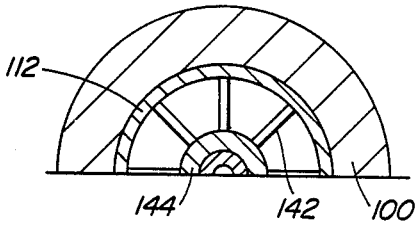

FIGS. 12A, 12B, and 12C collectively represent a longitudinal half section of a modified apparatus for producing a pulsating flow of drilling fluid in accordance with the invention;

FIGS. 13, 14, and 15 are cross-section views of the apparatus taken along line 13—13, 14—14 and 15—15, respectively, of FIG. 12.

Figure 16:
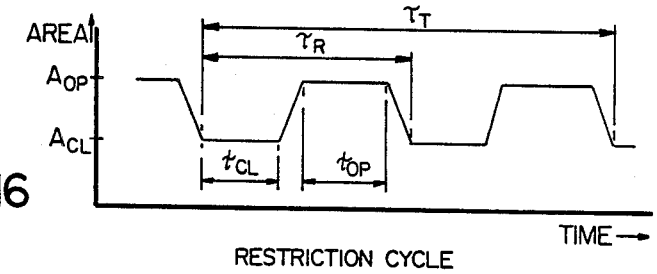

FIG. 16 is a typical restriction cycle for the flow pulsing apparatus of FIG. 12.

DESCRIPTION OF THE PREFERRED EMBODIMENTS

Figure 1:
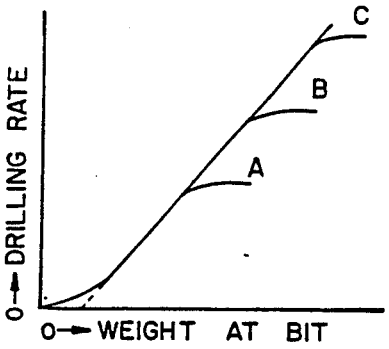
FIG. 1 is a graph illustrating the relationship between drilling rate and bit weight and illustrating the effect that increased cleaning or better chip removal has on drilling rate.

Reference will be had firstly to FIG. 1. As noted previously the effect of bit weight on penetration rate is well known. With adequate cleaning, penetration rate is directly Proportional to bit weight. There are some limitations depending of course upon the type of formation being drilled. There is also, in any particular situation, a maximum upper limit to the magnitude of the weight which the bit can withstand.

With reference to FIG. 1, it will be seen that drilling rate is generally proportional to bit weight up to point A where drilling rate drops off rapidly owing to inadequate cleaning which means that formation chips are being reground. From point A, increased cleaning resulted in a proportional increase in drilling rate up to point B where, again, inadequate cleaning was in evidence with a consequent fall off in drilling rate. Again, by increasing the cleaning effect, drilling rate once again became proportional to bit weight up to point C where again, a fall off in drilling rate is in evidence.

FIG. 1 thus demonstrates clearly the importance of effective hole bottom cleaning in obtaining an adequate drilling rate.

It is noted that FIG. 1 has been described mainly in relation to the drilling of harder formations. In softer formations, where the hydraulic action of the drilling fluid does at least part of the work, the relationships shown in FIG. 1 would still apply, although for somewhat different reasons, as those skilled in the art will appreciate.

Figure 2:
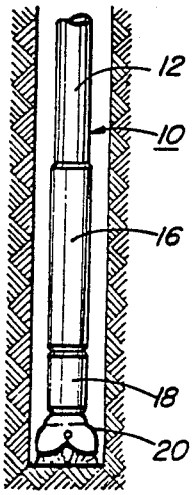
FIG. 2 is a longitudinal section at the bottom of a well bore illustrating apparatus according to the invention connected in the drill string immediately above the drill bit.
Figure 4:
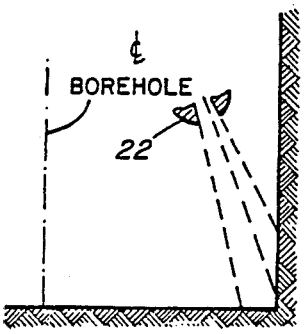
FIG. 4 is a diagrammatic view of the bottom end of a bore hole illustrating a jet of drilling fluid emitted toward the wall and bottom of a bore hole.

Referring now to FIG. 2, there is shown in cross section the lower end portion of a bore hole within which the lower end of a drill string 10 is disposed, such drill string including sections of hollow drill pipe connected together in the usual fashion and adapted to carry drilling fluid downwardly from drill pumps (not shown) located at the surface. The drill string is driven in rotation by the usual surface mounted equipment also not shown. Attached to the lower end of the drill collar 12 via the usual tapered screw thread arrangement is a drilling fluid flow pulsing apparatus 16 in accordance with the invention. To the lower end of the flow pulsing apparatus is connected a relatively short connecting sub 18 which, in turn, is connected via the usual screw threads to a drill bit 20 of conventional design having the usual rolling cone cutters and being equipped with a plurality of cleaning jets suitably positioned to apply streams of drilling fluid on to those regions where they have been found to be most effective in removing chips from the bottom of the well bore. One of such cleaning jets 22 is diagrammatically illustrated in FIG. 4 (the remainder of the drill bit not being shown) thereby to illustrate the manner in which the jet of drilling fluid is directed against the side and bottom portions of the well bore during a drilling operation. The location and arrangement of the jet openings on the drill bit 20 need not be described further since they are not, in themselves, a part of the present invention but may be constructed and arranged in an entirely conventional manner.

Figure 3:
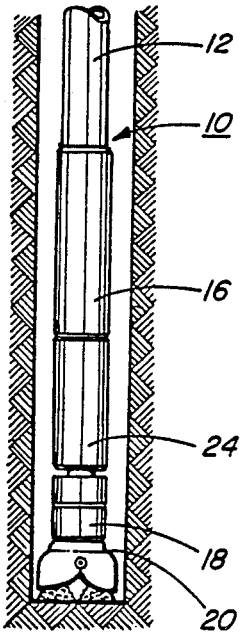
FIG. 3 is a view similar to that of FIG. 2 but additionally incorporating a form of shock tool located immediately below the means for producing the pulsating flow of drilling fluid.

FIG. 3 is a view very similar to that of FIG. 2 and like components have been identified with the same reference numbers as have been used in FIG. 2. However, it will be seen from FIG. 3 that, interposed between the flow pulsing apparatus 16, and the lower connecting sub 18, is a shock tool 24. As will be described in further detail hereafter, this shock tool is arranged to respond to the fluctuating or pulsing fluid flow being emitted from flow pulsing apparatus 16 thereby to cause vibration or oscillation of the drill bit 20 in the direction of the drill string axis thereby to further enhance the efficiency of the drilling operation.

Figure 5:
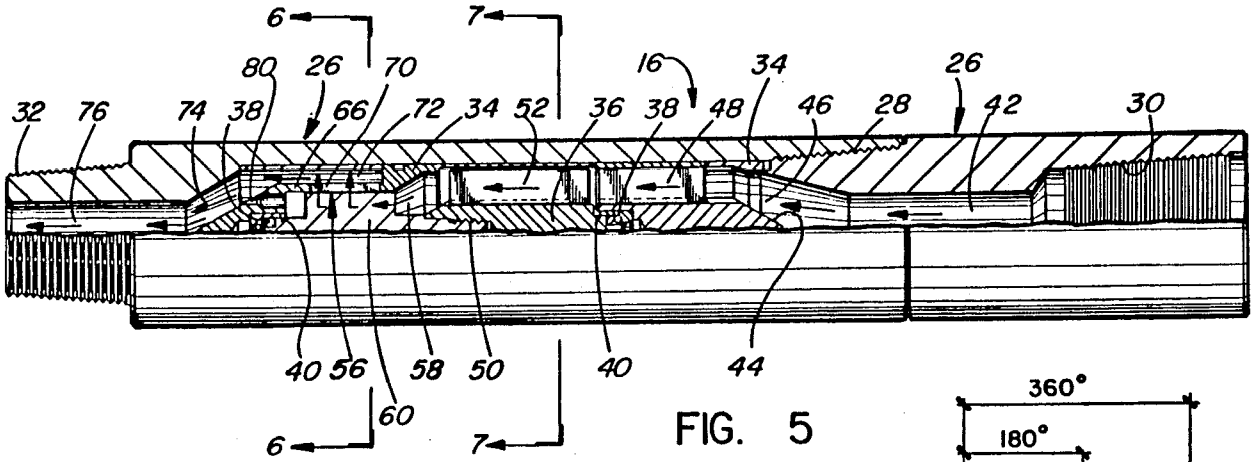
FIG. 5 is a longitudinal half section of apparatus for producing a pulsating flow of drilling fluid in accordance with the invention.
Figure 7:
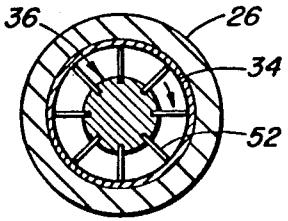
FIG. 7 is a cross section view taken along line 7—7 of FIG. 5.
Figure 6:
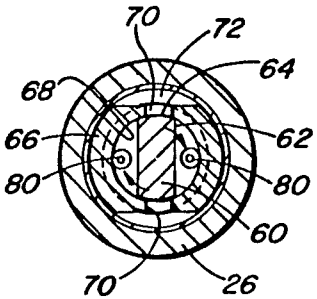
FIG. 6 is a cross section view taken along line 6—6 of FIG. 5.

Referring now to FIGS. 5, 6 and 7, the flow pulsing apparatus 16 is shown in detail. Apparatus 16 includes an external tubular housing 26, the wall of which is sufficiently thick as to withstand the torsional and axial forces applied thereto during the course of the drilling operation. Housing 26 is in two sections which are connected together via tapered screw threaded portion 28, with the upper end of the housing having a tapered internally threaded portion 30 adapted for connection to a lower end Portion of the drill string. The housing 26 also includes a tapered externally threaded section 32 adapted to be screwed into the connecting sub 18 which in turn is connected to drill bit 20 as illustrated in FIG. 2 or, alternatively, threaded into the upper end of the shock tool 24 illustrated in FIG. 3.

Housing 26 contains therein an elongated stator portion 34 within which an elongated rotor 36 is journalled via ball bearing assemblies 38 located at the upstream and downstream end of the rotor. It will be noted that ball bearing assemblies 38 are arranged as thrust bearings thereby to effectively take up any axial loadings applied in use to rotor 36. Annular seals 40 located in suitable annular grooves in the rotor help to prevent entry of contaminants into bearings 38.

The housing 26 has, adjacent the upstream end thereof, a central bore 42 defining a passageway for the flow of drilling fluid into the interior of the housing. The upstream end of stator 34 includes a flow diverting portion 44 which diverts the flow into a generally annular region 46, such annular region including a plurality of radially arranged straight stator blades 48, each such stator blade 48 lying in a plane which intersects the longitudinal axis of housing 26. The stator blades 48 extend from the central or hub portion of the stator outwardly to the inner periphery of the stator and the same are securely connected to the stator as by welding. The purpose of the straight stator blades is to prevent creation of a rotating vortex which would tend to reduce the efficiency of the fluid turbine to be hereafter described. In a typical embodiment, the stator may include about eight such blades 48 equally angularly spaced apart around the axis of the housing 26.

The rotor 36 is positioned immediately downstream of stator blades 48, such rotor 36 being made in two sections firmly secured together via screw threads 50. The upstream portion of rotor 36 is provided with a plurality of equally spaced radially extending blades 52, as best seen in FIG. 7. Each of these blades spirals around a central portion or hub of the rotor by a preselected amount and, in the embodiment shown, these helical blades 52 spiral around the rotor hub in the left hand direction so that, upon flow of drilling fluid through the turbine, the rotor rotates to the right, i.e. in the clockwise direction as shown in FIGS. 6 and 7. The individual rotor blades 52 are securely welded to the hub or core portion of the rotor while the outer edges of same are in closely spaced relationship to the thin walled portion of the stator 34 as clearly shown in FIG. 5.

Downstream of the rotor blades 52, both the rotor and stator are arranged to provide a rotary valve broadly designated by reference 56. With reference to FIGS. 5 and 6, both the rotor and stator are shaped immediately downstream of rotor blades 52 so as to provide an open annular chamber 58 for the drilling fluid. The rotor 36 includes a valving section comprising a valve member 60 having generally flattened side walls 62 and arcuate end walls 64. This valving member 60 rotates within a valving section 66 of the stator, such valving section 66 being arranged to cooperate closely with the valving member 60 of the rotor and, for this purpose, stator valving section 66 includes smooth surfaced concavely curved cylindrical segments 68 extending about the axis of rotation of the rotor 36 and arranged to cooperate with the convexly curved cylindrical segment walls 64 of the rotor valving member 60. Stator valving section 66 also includes oppositely disposed fluid exit ports 70 which are radially arranged relative to the rotation axis of the rotor 36 and which communicate with diametrically opposed fluid passageways 72 which extend in the axial direction to carry the drilling fluid in a downstream direction. These passageways 72 communicate with further fluid passageways 74 which converge together and communicate with a further main fluid passageway 76 which leads outwardly of the downstream end of the flow pulsing apparatus.

It should also be noted that the stator 34 is provided with a pair of diametrically opposed relatively small axially disposed fluid passageways 80 which, as best seen in FIG. 6, are unaffected by the relative angular position between rotor 36 and stator 34. In other words, these smaller passages 80 serve to pass drilling fluid through the apparatus at all times. It might be noted here that for purposes of fine tuning the apparatus, bushings could be inserted into the passages 80 thereby to provide continuous flow passages of the exact size desired. It is furthermore noted here that since the drilling fluid may contain a certain amount of gritty contaminants that there should not be a close running fit between arcuate wall portions 64 of the rotor valving section and cylindrical segment walls 68 of the stator valving section. Rather, a small radial gap should be left between them so that such small particles will not cause undue abrasion or even, in extreme cases, tend to cause binding of the rotor and stoppage of same.

Figure 8:
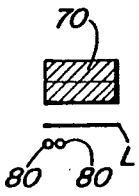
FIG. 8 is a diagrammatic view illustrating the relative sizes of the main ports and the continually open ports and leakage areas provided by the valving means of the apparatus shown in FIGS. 5–7.

FIG. 8 illustrates diagrammatically both the main ports 70 as well as the continually open ports. The main ports 70 each define effective flow passage equal to the full size of such port with each port being closed two times for each revolution of the rotor 36. With reference to the continually open ports 80, as noted above, these may be provided with bushings to provide the desired flow area. The total flow area provided by ports 80 would be as a general rule of thumb about as large as the total flow area provided by the jet nozzles in the drilling bit. Another effectively open port illustrated diagrammatically in FIG. 8 is the leakage area around the main ports caused by the above-noted clearance between arcuate walls 64 of the rotor valving section and the interior cylindrical walls of the stator valving section. This leakage area is relatively small in comparison with the other flow areas referred to and is not sufficiently important as to warrant further discussion.

In the operation of the apparatus shown in FIGS. 5 through 7, it will be assumed that the drill string is rotated in the usual fashion, thus effecting rotation of housing 26 and the stator 34 which is fixed thereto with rotation of the housing being ultimately transmitted to the previously noted drill bit 20. The drilling fluid or mud pumps located at the surface create a downward flow of drilling fluid through the interior of the drill string and this enters the axial bore 42 provided in the housing, such flow entering via annular region 46 into the flow passages defined between the straight stator blades 48. This flow, in the axial direction, then enters the turbine section of the rotor and, by virtue of the helical shape of the rotor blades 52, the rotor 36 is caused to rotate in the right-hand direction. As the rotor rotates, the valving section 60 of the rotor also rotates therewith thus intermittently opening and closing the fluid exit ports 70. The ports 80, as described previously, continue to pass a relatively small portion of the flow therethrough at all times. By virtue of this action, a fluctuating or pulsating flow of the fluid is allowed to pass through the valving section and outwardly through the axial passage 76 at the lower end of the flow pulsing apparatus 16.

With reference to FIGS. 5–7 it will be noted that the rotor 36 including valving member 60 is substantially fully exposed to and bathed in the drilling fluid which is located on the upstream side of the radially arranged exit ports 70. Hence hydraulic forces acting on the rotor 36 during use virtually cancel each other out and the rotor support bearings 38 are thus protected from the high fluctuating hydraulic loads which would otherwise tend to cause premature bearing failure.

Figure 9:
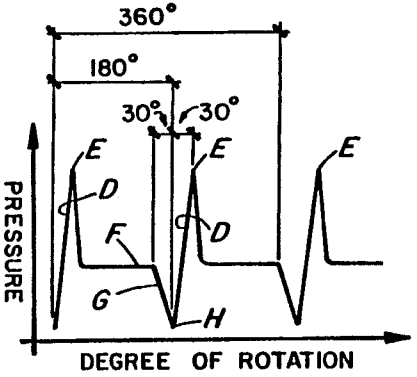
FIG. 9 is a graph illustrating the bit-jet pressure as a function of the angular position of the rotor.

FIG. 9 is a graph illustrating the bit-jet pressure made available during operation of the apparatus described above. It will be appreciated that the pressure of the drilling fluid supplied to the apparatus is a function of several different items. One component of the pressure comprises the hydrostatic pressure which is directly proportional to the height of the column of drilling fluid standing in the drill string. This of course varies directly in accordance with the depth of the drill bit below the surface. The second component of the applied pressure is the pressure supplied by the drilling fluid pumps on the surface, which pressure is available to push the flow of drilling fluid through the jets in the drilling bit.

With reference to FIG. 9, the two components of the applied pressure, namely, the hydrostatic pressure and the pump pressure, are clearly illustrated. The pressure profile shown would be the pressure as measured downstream of the valving arrangement as, for example, in passageway 76. The pressure profile upstream of the valving arrangement, e.g. in port or passageway 42 would be essentially a mirror image of the pressure profile shown in FIG. 9. It will be appreciated that as the exit ports 70 are closed off by rotation of rotor valving section 60, that the momentum of the drilling fluid in the drill string creates a water hammer effect which, as is well known, means that the flow energy of the fluid is being converted into dynamic pressure energy. Thus, as ports 70 are closed, the pressure of the fluid on the upstream side of the valving arrangement increases. Then, with continued rotation of the rotor, the exit ports 70 begin to open and this high pressure appears on the downstream side of the valve. Thus as ports 70 are being opened, the pressure on the downstream side is increasing as illustrated by part D of the pressure curve. The peak pressure occurs at point E. As the valve moves to full open position this pressure is gradually dissipated and falls down to the nominal pressure F. Then, with continued rotation of the rotor, the pressure on the downstream side of the valving arrangement drops suddenly as illustrated by section G of the pressure curve, reaching a minimum pressure at point H. At point H, representing minimum downstream pressure, it will be realized that, owing to the above-mentioned water hammer effect, the pressure on the upstream side of the valve will be at a maximum and hence as the ports 70 begin to open this pressure increase will be transmitted through the rotary valve thus resulting in a rapid pressure increase along section D, as noted previously, with the result being that peak downstream pressure E is again exhibited. This procedure repeats itself in a cyclical fashion, and, with the apparatus as illustrated in FIGS. 5–7, it will be appreciated that two complete pressure cycles as illustrated in FIG. 9 are achieved for each complete rotation of the rotor 36.

It will of course be appreciated that the pulsing action described above causes a pressurized pulsating flow of drilling fluid to be made available to the drill bit. By varying the size of the continually open passages 80 in relation to the size of the exit ports 70, the peak pressures attained can be made considerably larger than the nominal pressure. It should be possible to make the peak pressure to be double the nominal pressure or even triple the nominal pressure depending on the end use desired. It should also be noted here that the frequency of the pulsation can be varied by changing the helix angle on the rotor blades 52. The faster the rate of rotor rotation, the higher the pulsation rate. By way of example, a pulsation rate or frequency in the order of 1200 cycles/minute has been successfully used; however, it is expected that frequencies of twice this value, or even more in some cases, could be-used.

It is important to realize that the Pulsating pressurized flow being applied to the cleaning nozzles or jets of the drill bit provides greater turbulence and greater chip cleaning effect than was hitherto possible thus increasing the drilling rate in harder formations. In softer formations where the eroding action of the drill bit jets has a significant effect, the pulsating, high turbulence action also has a beneficial effect on drilling rate. By making use of the water hammer effect, these high peak pressures are attained without the need for applying additional pumping pressure at the surface thus meaning that standard pumping pressures can be used while at the same time achieving much higher than normal maximum flow velocities and pressures at the drill bit nozzles.

In the embodiment described above, owing to the water hammer effect created as a result of the intermittent or fluctuating flow of fluid, mechanical vibrating forces will be applied to the flow pulsing apparatus which will act in the direction of the drill string axis, which pulsing or vibrating action will be advantageously transmitted to the drill bit. This pulsating mechanical force on the drill bit complements the pulsating flow being emitted from the drill bit jet nozzles thereby to further enhance the effectiveness of the drilling operation, i.e. to increase the drilling rate.

Figure 10:
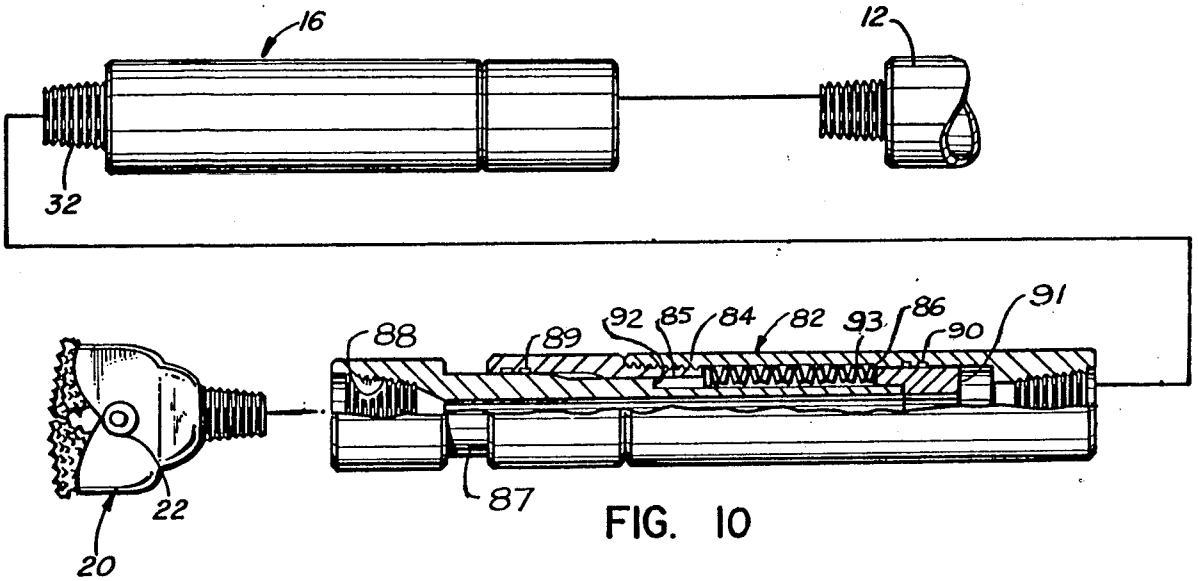
FIG. 10 is an exploded view of apparatus in accordance with the present invention incorporating, in addition, a shock tool which is interposed between the drill bit and the apparatus for producing the fluctuating flow of drilling fluid.
Figure 11:
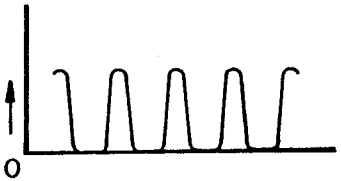
FIG. 11 is a graph illustrating the loadings on the drill bit resulting from the use of the apparatus illustrated in FIG. 10.

The above-described mechanical pulsing action can be further enhanced by the use of the apparatus illustrated in FIG. 10. In FIG. 10 a form of shock tool 82 is connected via the usual tapered screw threads 83 to the lower end, i.e. the outlet end of the flow pulsing apparatus 16. The shock tool 82 includes an outer casing portion 84, within which is slidably located an elongated mandrel 87. The lower end of mandrel 87 has an internally threaded section 88 which allows the same to be connected to the drill bit 20 either directly or by way of a short sub section.

Suitable annular seals 89 and 90 are provided between the housing 84 and the upper and lower ends of the mandrel 87 thereby to assist in preventing contaminants from entering between these two components and hindering their relative axial movement. The upstream and downstream ends of mandrel 87 are provided with a collar portion 91 and ledge 92 and these provide annular steps against which the upper and lower ends of a spring stack 93 alternately engage during operation. The lower and upper ends of spring stack 93 rest against shoulders 85, 86 respectively, fixed relative to housing 84. This spring stack 93 is conveniently comprised of a plurality of annular belleville-type washers although any suitable compression spring means may be provided.

It will be seen by reference to FIG. 10 that the upper end of the mandrel, as well as the central passageway through the mandrel, which is filled with pressurized drilling fluid during use, in effect defines an open area piston. During operation there is of course a pressure differential between the pressure of the drilling fluid within the mandrel and the pressure of the drilling fluid which is outside of the shock tool 82 altogether, namely, the drilling fluid which is returning upwardly between the tool and the wall of the well bore. By virtue of the fact that the drilling fluid leaving the flow pulsing apparatus 16 is pulsating at a predetermined frequency as noted above, this pressure differential also is varying accordingly and as this pulsating differential pressure acts on the open area piston noted above, it serves to extend the mandrel 87 relative to the housing 84 with the result being that the shock tool 82 effectively performs as a "mud hammer". Those skilled in this field will appreciate that for this action to take place the drill bit weight shall be reduced by lifting up on the drill string so that the latter does not apply any appreciable downward force to the bit. This hammering effect is of course directly transmitted to the drill bit 20. Again, the drilling fluid leaving the jet openings 22 in drill bit 20 will be subject to the pressure fluctuations described above and will exhibit the desired enhanced hydraulic effect. The shock tool 82, behaving as a "mud hammer" applies a strong pulsing or vibrating action to the drill bit thus causing it to drill more effectively. At the same time, it should be realized that the peak loadings applied to the drill bit are somewhat less than in the case of a conventional mud hammer in that, owing to the hydraulic action involved, the pressure peaks are somewhat rounded or curved as illustrated in FIG. 14. These curved peaks effectively create less damage to the drill bit at higher loadings thus resulting in a longer bit life.

The use of the shock tool 82 as shown in FIG. 10, is optional and under many drilling conditions its use is unnecessary.

A very desirable modification of the flow pulsing apparatus is shown in FIGS. 12 through 16. This modification, as before, includes an elongated tubular housing 100, the upper end of which is connected by screw threads 102 to a tubular screen sub 104, the upper end of sub 104, in turn, having internal tapered screw threads 106 for connection to the lower end of a hollow drill string (not shown). The lower end of housing 100 is internally threaded at 107 to provide for connection to a shock tool as described previously and/or a drill bit (not shown). The housing 100 has a removable cylindrical cartridge 108 located therein, the cartridge 108 containing the rotor and valve means to be hereafter described. For purposes of this disclosure, the cartridge shell, which includes portions 110 and 112, may be considered to be part of the housing means. The cartridge shell portions 110 and 112 are screwed on to opposing ends of a hollow metal casting 114. Casting 114 includes an upstream portion 116 of a somewhat conical exterior shape and centered within the housing such that the flow of drilling fluid, indicated by arrow F, moves into the annular region 118 and approaches the valve section 119 to be hereafter described.

An elongated rotor 120 is journalled for rotation about the longitudinal axis of the housing within the cartridge shell. The front end of rotor 120 is journalled in conical portion 116 while the downstream end is journalled within a turbine stator assembly 121. The rotor 120 includes a cast metal body 122. The upstream end of the rotor includes a valve section 128 while the downstream end includes turbine section 127.

The valve section 119 of the housing means includes a pair of diametrically opposed ports 124 which define flow passages extending radially relative to the axis of rotation of rotor 120. These ports are formed in the hollow metal casting 114 and communicate with the annular region 118 noted above. An annular valve port insert of 126 of very hard material, such as tungsten carbide, fits snugly into a recess provided in the interior of casting 114, and is held in place with a retainer ring clip 129 and a non-rotation pin. Insert 126 is provided with a cylindrical inner surface 130 and the valve ports 124 extend through this insert. Preferably, the valve port sections defined in the insert 126 are made smaller than the corresponding valve port sections in the casting 114 such that most of the wear due to the presence of abrasives in the drilling fluid takes place in the insert 126.

The rotor valve section 128 includes a pair of diametrically opposed vane sections 132 which extend outwardly from the axis of rotation. The outer ends of vane sections 132 include recesses therein which mount an opposed pair of rotor vane inserts 134. These insets 134 include smooth outer surfaces 136 formed as cylindrical segments curved to match the cylindrical inner surface 130 of valve port insert 126. The vane inserts 134 are each secured in place by a pair of threaded pins 138 which extend lengthwise through the inserts with their opposing ends being located in shoulder Portions defined by the above-noted vane section 132. Rotor vane inserts 136 are also preferably made from a hard wearing material such as tungsten carbide. After the valve inserts 126 and 136 become worn, they can be readily replaced by removing retainer ring 128 and pins 138 and thereafter installing new ones.

As part of the means for preventing seizure of the rotor 120 due to the presence of gritty particles between the annular valve insert 126 and the vane inserts 134, provision is made for a degree of radial clearance C between the inner surface 130 of insert 126 and the outer surfaces 136 of vane inserts 134. This will be described in further detail later on.

The downstream end of the rotor 120 includes the turbine section 127. This comprises a plurality of radially outwardly extending blades 140 (FIG. 14), each of which is curved into a helical shape so that the flow of drilling fluid exerts torque on the rotor to rotate the same. The individual rotor blades 140 are securely welded to a ring 141 which is heat shrunk on to rotor body 122 while the outer edges of the blades are in closely spaced relationship to the inside wall of the cartridge shell.

Immediately downstream of the rotor is the stator assembly 121. The stator comprises a plurality of radially arranged straight blades 142 which extend from a central hub 144 outwardly to the inside wall of the cartridge shell. These blades 142 thus secure the hub 144 firmly in position and enable hub 144 to support the downstream end of the rotor 120.

The manner in which the rotor 120 is rotatably supported will now be described. Mounted within a bore in the upstream end of the conically shaped casting 116 is a cup-shaped spring housing 148, the same being held in place by retainer ring 150. A bearing sleeve 152 is located in this same bore in abutting relation to housing 148 and bears against an annular shoulder at the end of the bore. A coil compression spring 154 is located within spring housing 148 and extends into the bearing sleeve 152. A short cylindrical thrust bearing block 156 is located in the bearing sleeve in engagement with the coil spring 154. The upstream end of the rotor has a short cylindrical rotor shaft 158 rigidly fixed thereto and projecting outwardly therefrom in the upstream direction, which shaft 158 is received within the bearing sleeve 152 in abutting relation to the thrust bearing block 156. The end of shaft 158 has a convexly curved spherical or spheroidal surface which makes almost point contact with the bearing block 156 thereby to cut down on the amount of friction involved. A similar arrangement supports the downstream end of the rotor. The upstream end of the stator hub 144 is in an interference fit with a shaft holder 160 to which, in turn, is rigidly affixed a short cylindrical shaft 162. The downstream end of the rotor 120 has a bore therein which receives a spring housing 164 and a bearing sleeve 166, these being held in place by retaining ring 167. A coil compression spring 168 is located within housing 164 and bears against thrust bearing block 170 which, in turn, bears against the convexly curved spherical or spheroidal end surface of shaft 162 which is received within the bearing sleeve 166.

In order to reduce wear arising from gritty contaminants, both of the bearing sleeves 152 and 166 together with the shafts 158 and 162 and the thrust bearing blocks 156, 170 are made of an extremely hard material, preferably tungsten carbide.

It will be noted from FIG. 12 that the rotor 120 is free to move axially a substantial distance (e.g. about one-half inch). Since the rotor 120 is completely immersed in the drilling fluid of uniform pressure throughout, the hydraulic forces on it cancel each other out, i.e. there is no net hydraulic force on the rotor. Further, the compression springs 154 and 168 are of similar strength. Hence, in use, the rotor 120 is free to move axially in both directions. Additionally, the cylindrical shafts 158 and 162 are only loosely journalled in the respective bearing sleeves 152 and 166. It has been found by experiment that the degree of radial clearance between each shaft and its sleeve should be from about 0.020 inch to about 0.050 inch. Hence, during operation, the rotor 120 is free to move transversely of its rotation axis by a total distance of from about 0.040 to 0.10 inches. It will also be noted that no seals whatsoever are provided which would tend to inhibit the free flow of the drilling fluid into or out of the rotor support bearing assemblies. The drilling fluid hence provides a lubricating effect on the bearings. A further important point is that the rotor 120 is deliberately dynamically unbalanced. The degree of imbalance is not important. In practice, the rotor body is cast in sand using the normal dimensional tolerances common to such practice. Following completion of casting, the rotor is machined only to the extent necessary to remove very rough portions and to provide bores to receive the shaft 158, housing 164 and bearing sleeve 166. With this small amount of machining there is a virtual guarantee that the rotor will be dynamically unbalanced. Hence,during operation, as the drill string vibrates upwardly and downwardly due to the water-hammer effect produced by the periodic interruption of the flow of drilling fluid, the rotor 120 vibrates relative to the housing 100 both axially and transversely of the axis of rotation thus providing a self-cleaning effect which clears abrasive particles out of the rotor support bearing assemblies as well as clearing gritty contaminants away from between the annular valve insert 126 and the rotor valve inserts 134. It has been found that by inducing movement of the drilling fluid into and Out Of the bearings that relatively long bearing life can be achieved. Large particles which would tend to remain between the co-operating surfaces and create deep score lines, are moved away before they can create significant damage.

It was noted above that a degree of radial clearance C is provided between the inner surface 130 of valve port insert 126 and the outer surfaces 136 of rotor vane inserts 134. In the embodiment shown, the degree of radial clearance C is preferably in the order of 0.075 inch (Experiments have shown this value to be suitable when a drill fluid screen (to be described) is provided having screen apertures of about ¼ inch diameter. With larger screen openings there is a danger of rotor stalling unless the clearance C is increased). If it were not for the vibrating action of the rotor as described, this clearance would have to be much larger, approaching a radial clearance of 0.095 inch, to ensure that large particles would not bind the rotor. However, the larger the clearance, the larger the area of fluid flow path when the rotary valve closes and the smaller the water-hammer effect. If it were possible to remove all gritty contaminants from the drilling fluid, the above noted clearance C could be made very small thereby to achieve the maximum pressure rise and maximum water-hammer effect. Since this is not practical, the present invention helps to ensure that the clearance C can be made as small as reasonably possible while at the same time the gritty contaminants are induced to move away from the relevant surfaces of the rotary valve members and the bearing surfaces thus greatly increasing bearing life and avoiding problems of jamming or binding due to the presence of gritty contamination. The above-described arrangement is capable of providing an operating life of more than 1000 hours (which is very significant considering that a life of 200 hours for a tool of this nature would have previously been considered adequate).

When the flow pulsing apparatus is due to be serviced and the drill string is pulled out, the entire cartridge assembly can be quickly removed and replaced with a new cartridge. The old cartridge can be dismantled and the various tungsten carbide inserts and other components replaced thus assuring that the major part of the tool is re-used again and again. Another advantage of the removable inserts, i.e. annular valve port insert 126 and rotor vane inserts 134, is that the size and shape of these components can be varied thereby to allow the tool to be tuned to accommodate different flow volumes and frequency ranges, hence allowing the same basic tool to be used in a variety of situations.

Another notable feature is that of the screening arrangement for removing large pieces of debris and rock cuttings from the drilling fluid. With reference again to FIG. 12 it was noted that a tubular screen sub 104 extends upstream from the tool. The screen sub 104 includes an elongated cylindrical chamber 180 therein which extends from the upper internally threaded (106) end portion to an annular step 182 which is located a distance from the opposite end. An elongated cylindrical screen 184 extends within the chamber 180 in spaced relation to the interior wall 186 of same. Screen 184 has an upstream end closed by a screwed-on metal cap 188 while the downstream end extends beyond the step 182 in close proximity to the wall of an axial passage 190 in the downstream end of sub 104 and is connected to a bell housing 192. Housing 192 feeds the flow of drilling fluid into the annular region 118 between cone shaped portion 116 and the inner wall of the cylindrical cartridge.

The cylindrical screen 184 is provided with a multiplicity of circular screen openings 194, the same being preferably arranged in axially spaced apart circumferentially arranged arrays. In one embodiment the upstream one-third of the screen is provided with openings **194*a* which are larger than the openings 194*b* in the downstream two-thirds of the screen. The openings 194*a* are one-half inch diameter while openings 196*b*** are of one-quarter inch diameter.

In operation, the flow of drilling fluid passes along the annular region 196 defined between the inside wall 186 and the screen 184. When the screen is reasonably clean, the flow and the contained particles, by virtue of momentum forces, tend to travel along such annular region outside of the screen toward the annular step 182 until being forced to move inwardly through the smaller screen openings 194 adjacent step 182. The larger particles remain on the outside of the screen and gradually migrate toward the step 182, thus building up a deposit of such material in this annular zone. This process continues for a long period of time and, unless the tool is pulled out of the hole for other reasons, the build-up of material will gradually close off all of the smaller screen holes 194*b* at which point the flow will begin to pass through the larger holes 194*a*. The screening effect will not be as good as before and there is a greater danger of the rotor jamming; however, the larger holes help to ensure that adequate flow is maintained, even with the majority of the screen holes plugged, until the tool is pulled from the hole for maintenance purposes. The larger screen holes at the upstream end thus help to extend the useful life of the tool between service interruptions.

The operation of the above described modification will be readily apparent from the above description. The flow of drilling fluid passes along the screen sub 104 through the screen 184 and thence axially along the tool and radially inwardly through the ports 124 of the valve section 119. By virtue of the clearance C between the valve port insert 126 and the rotor vane inserts 134 there is sufficient flow of drilling fluid past the turbine section 127 as to move the rotor 120 away from the stalled position. As the rotor 120 begins to rotate, it periodically effects a restriction of the flow thus creating a water hammer effect in the drilling fluid by virtue of the momentum forces generated. This water hammer effect causes a pulsing action in the fluid being supplied to the drill bit (not shown). As well, this pulsing action effects up and down vibration of the drill string. By properly selecting the size of the port openings 124 and the dimensions of the rotor valve section 128, the frequency of vibration of the tool can be made to conform with the natural frequency of the overall drilling system thereby to ensure that the full effect of the pulsating force is achieved. FIG. 16 illustrates a typical restriction cycle wherein the flow area through the rotary valve is plotted against time. The flow area is at a maximum at Aop (valve full open) and at a minimum at Acl(valve closed). The period of the restriction cycle is of course a function of rate of rotor rotation and the times of closure (Tcl)and opening (Top), are of course dependent on the dimensions of the rotary valve section components and the speed of rotor rotation. As noted previously, the valve inserts 126, 134 can be changed or replaced with a differently dimensioned set to allow the tool to be tuned to match any particular set of conditions.

As the rotor 120 rotates, it vibrates in its loose bearings both along and transversely to the axis of rotation. As described previously, this vibration arises due to the inherent dynamic imbalance of rotor 120 and also due to the axial vibration of the drill string arising from the periodic restriction or interruption of the drilling fluid and the resulting water hammer effect. By virtue of this vibration gritty particles in the drilling fluid are cleared away from the rotor support bearings and from the region between the insert 126 which defines the valve ports 124 and the rotor vane inserts 134 as described in detail previously. The overall result is a very effective drilling tool capable of providing a much longer service life with a great reduction in down time as compared with previously available devices of this general nature.

Numerous modifications and variations will become apparent to those skilled in this art in the light of this specification. Accordingly, the invention is not to be limited to the specific embodiments disclosed but is to cover all modifications and equivalents as fall within the spirit or scope of the invention.

I claim:

1. Apparatus for providing pulsations in a flow of drilling fluid to a rotary drill bit comprising: a housing adapted to be connected in a tubular drill string above a drill bit and to be supplied, in use, with pressurized drilling fluid via the tubular drill string, said housing having flow passage means for the flow of the drilling fluid therethrough from an inlet to an outlet end of said housing; rotor means in said housing adapted to rotate relative to said housing about an axis of rotation in response to the flow of fluid through said housing, said rotor means having a valving section including a rotary valve member; bearing means for rotatably supporting said rotor means in said housing; said flow passage means including valve port means located in a valving section of said housing, and said rotary valve member being arranged to rotate about the axis of rotation in close cooperating relation to said port means to alternately open and close said port means during rotation in close cooperating relation to said port means to alternately open and close said port means during rotation of the rotor means to provide a cyclical restriction of the flow passing through said flow passage means to create, during use, a water hammer effect in the drilling fluid thus resulting in pressure peaks in the fluid being supplied to the drill bit and a pulsating mechanical force on the drill bit; said rotor means, including its rotary valve member, being arranged relative to said housing and the valving section such that in use, the rotor means is substantially fully exposed to and bathed in the drilling fluid and the hydraulic forces acting on said rotor means during use are taken up internally by said rotor means and are not transmitted to any substantial degree to said bearing means.

2. Apparatus according to claim 1 wherein said housing includes a longitudinal axis which in use, is aligned with the longitudinal axis of the drill string, said axis of rotation of the rotor being parallel to or aligned with the longitudinal axis of the housing, and said valve port means extending generally radially outwardly relative to said axis of rotor rotation.

3. Apparatus according to claim 2 wherein said valving section of said housing defines concavely curved cylindrical wall means extending around said axis of rotation, said port means interrupting said cylindrical wall means, said rotary valve member having convexly curved cylindrical segment walls, arranged to come into close co-operating relation with said cylindrical wall portions of the housing valving section so as to alternately open and close said port means during rotation of said rotor to cyclically interrupt the flow therethrough.

4. Apparatus according to claim 2 wherein said rotary valve member includes a pair of said cylindrical segment walls oppositely disposed relative to each other, there being a pair of said radially extending port means oppositely disposed relative to each other.

5. Apparatus according to claim 3 wherein a radial gap is provided between the cylindrical segment walls of the valving section of the housing and the cylindrical segment walls of the rotary valve member so that gritty contaminants in the drilling fluid will not cause undue abrasion of such walls and/or binding and stoppage of the rotor.

6. Apparatus according to claim 1 including further flow passages in said housing valving section for the drilling fluid which are unaffected by and remain open during rotation of said rotary valve member.

7. Apparatus according to claim 1 wherein said rotor means includes a turbine section having blades thereon adapted to apply torque to said rotor in response to the flow of the drilling fluid through said housing and said turbine section.

8. Drilling equipment comprising the apparatus of claim 1 and including a drill string connected to the inlet end of said housing to supply pressurized drilling fluid in the form of drilling mud thereto and a drill bit having jet openings for the drilling mud connected downstream of the outlet end of said housing.

9. Drilling equipment comprising the apparatus according to claim 1 in combination with a drill bit having jet openings for the drilling fluid, and a shock tool connected between said outlet end of said housing and said drill bit, said shock tool including a pair of relatively movable telescoping members arranged to receive and respond to the pulsating pressure of the fluid by expanding and contracting in length whereby to further impart a vibrating action to said drill bit during the course of rotary drilling.

10. Apparatus according to claim 1 wherein said rotor means includes a bladed section responsive to fluid flow thereover to apply torque to the rotor and wherein said flow passage means are arranged relative to said bladed section such that substantially the whole flow of the drilling fluid through said housing passes through the bladed section to effect rotation of the rotor.

11. Apparatus according to claim 1 wherein said rotor means includes a bladed section responsive to fluid flow thereover to apply torque to the rotor and wherein said flow passage means are arranged relative to said bladed section such that substantially the whole flow of the drilling fluid through said housing passes through the bladed section to effect rotation of the rotor, said housing being of elongated form and said inlet and outlet ends being at opposite ends of said housing, and said axis of rotation of the rotor being parallel to the lengthwise direction of said housing.

12. Flow pulsing apparatus adapted to be connected in a drill string above a drill bit and including a housing providing a passage for a flow of drilling fluid toward said bit; rotor means in said housing rotated by the flow of drilling fluid for periodically restricting the flow to create pulsations in said flow and a cyclical water hammer effect to vibrate the housing and drill bit during use, said rotor means being hydraulically balanced and dynamically unbalanced and subject to vibration during rotation, relatively loose bearing means supporting said rotor means for said rotation about a rotation axis and allowing a substantial measure of vibratory motion of said rotor relative to said housing, said bearing means being arranged such that the drilling fluid has free access into and out of such bearing means with said vibratory motion of the rotor providing a self-cleaning effect which cleans gritty particles away from said bearing means and wherein said bearing means comprises sleeve bearing means having shaft means loosely journalled therein and supporting opposing ends of said rotor means, said rotor means being free to vibrate relative to said housing both along the rotation axis as well as transversely thereto.

13. The flow pulsing apparatus of claim 12 wherein said housing means and rotor means have cooperating valve sections to periodically restrict said flow, said valve sections having cooperating surfaces between which a measure of clearance is maintained to reduce the probability of rotor binding due to the presence of gritty particles therebetween with said vibration of the rotor tending to remove any such particles from between said cooperating surfaces.

14. The flow pulsing apparatus of claim 13 wherein said sleeve bearing means and shaft means are made of tungsten carbide and wherein said valve sections include removable, replaceable inserts which define said cooperating surfaces, said removable inserts being made of tungsten carbide.

15. The flow pulsing apparatus of claim said housing defines a longitudinal axis which, in use, is aligned with the axis of said drill string, and said rotation axis of said rotor means being in alignment with said longitudinal axis.

16. The flow pulsing apparatus of claim 15 including resiliently biased thrust bearing means associated with said sleeve bearing means and applying oppositely directed forces to said rotor means along the rotation axis thereof, the rotor means also having a substantial degree of freedom in the axial direction so that the rotor can vibrate axially under the influence of the vibrations of said housing.

17. The flow pulsing apparatus of claim 15 wherein the degree of radial clearance between said sleeve bearing means and the shaft means journalled therein is from about 0.020 to about 0.050 inch.

18. Apparatus for providing a pulsating flow of drilling fluid to a rotary drill bit comprising: a housing adapted to be connected in a tubular drill string above a drill bit and to be supplied, in use, with pressurized drilling fluid via the tubular drill string, said housing having flow passage means for the flow of the drilling fluid therethrough from an inlet to an outlet end of said housing; rotor means in said housing adapted to rotate relative to said housing about an axis of rotation in response to the flow of fluid through said housing, said rotor means having a valve section including a rotary valve member; and bearing means for rotatably supporting said rotor means in said housing; said flow passage means including valve port means located in a valve section of said housing, and said rotary valve member being arranged to rotate about the axis of rotation in close cooperating relation to said port means to alternately open and close said port means during rotation of the rotor means to provide a cyclical restriction of the flow passing through said flow passage means to create, during use, a water hammer effect in the drilling fluid thus resulting in pressure peaks in the fluid being supplied to the drill bit and a pulsating mechanical force on the drill bit; said rotor means being dynamically unbalanced and subject to vibration during rotation, said bearing means loosely supporting said rotor means for rotation about said rotation axis and allowing a substantial measure of play and vibration of said rotor means relative to said housing, said bearing means being arranged such that the drilling fluid has free access into and out of such bearing means with said play and vibration of the rotor means providing a self cleaning effect which cleans gritty particles away form said bearing means and wherein said bearing means comprises sleeve bearing means having shaft bearing means journalled therein and supporting opposing ends of said rotor means, said rotor means being free to vibrate relative to said housing both along the rotation axis as well as transversely thereto.

19. The apparatus of claim 18 wherein said housing means and rotor means have cooperating valve sections to periodically restrict said flow, said valve sections having co-operating cylindrical surfaces centered at said axis of rotation and between which a measure of radial clearance is maintained to reduce the probability of rotor binding due to the presence of gritty particles there-between with said vibration of the rotor relative to said housing tending to remove any such particles from between said co-operating surfaces.

20. The apparatus of claim 19 wherein said housing defines a longitudinal axis which, in use, is aligned with the axis of said drill string, and said rotation axis of said rotor means being in alignment with said longitudinal axis.

21. The apparatus of claim 20 including resiliently biased thrust bearing means associated with said sleeve bearing means and applying oppositely directed forces to said rotor means along the rotation axis thereof, the rotor means also having a substantial degree of freedom in the axial direction so that the rotor can vibrate axially under the influence of the vibrations, of said housing.

22. The apparatus of claim 21 wherein the degree of radial clearance between said sleeve bearing means and the shaft means journalled therein is from about 0.020 to about 0.050 inch.

23. The apparatus of claim 22 wherein said sleeve bearing means and shaft means are made of tungsten carbide.

24. The apparatus of claim 23 wherein said valve sections include removable, replaceable inserts which define said co-operating surfaces, said removable inserts being made of tungsten carbide.

25. The apparatus of claim 22 wherein the clearance between the cylindrical surfaces of said valve sections is about 0.075 inch.

26. The apparatus of claim 20 wherein said rotor means is substantially fully bathed in said drilling fluid in such manner that said rotor is hydraulically balanced.

27. The apparatus of claim 18 wherein said rotor means is substantially fully bathed in said drilling fluid in such manner that said rotor is hydraulically balanced.

28. Drilling equipment comprising the apparatus of claim 18, and including a drill string connected to the inlet end of said housing to supply pressurized drilling fluid in the form of drilling mud thereto and a drill bit having jet openings for the drilling mud connected downstream of the outlet and of said housing.

29. Drilling equipment comprising the apparatus according to claim 18 in combination with a drill bit having jet openings for the drilling fluid, and a shock tool connected between said outlet end of said housing and said drill bit, said shock tool including a pair of relatively movable telescoping members arranged to receive and respond to the pulsating pressure of the fluid by expanding and contracting in length whereby to further impart a vibrating action to said drill bit during the course of rotary drilling.

30. Apparatus according to claim 18 wherein said rotor means includes a bladed section responsive to fluid flow thereover to apply torque to the rotor and wherein said flow passage means are arranged relative to said bladed section such that substantially the whole flow of the drilling fluid through said housing passes through the bladed section to effect rotation of rotor.

31. Apparatus according to claim 18 wherein said rotor means includes a bladed section responsive to fluid flow thereover to apply torque to the rotor and wherein said flow passage means are arranged relative to said bladed section such that substantially the whole flow of the drilling fluid through said housing passes through the bladed section to effect rotation of the rotor, said housing being of elongated form and said inlet and outlet ends being at opposite ends of said housing, and said axis of rotation of the rotor being parallel to the lengthwise direction of said housing.

* * * * *